US006293767B1

(12) United States Patent
Bass

(10) Patent No.: US 6,293,767 B1
(45) Date of Patent: Sep. 25, 2001

(54) SCROLL MACHINE WITH ASYMMETRICAL BLEED HOLE

(75) Inventor: Mark Bass, Wilder, KY (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 09/514,790

(22) Filed: Feb. 28, 2000

(51) Int. Cl.[7] ..... F04B 49/00

(52) U.S. Cl. ..... 417/310; 417/213; 418/55.5

(58) Field of Search ..... 418/55.5; 417/310, 417/213

(56) References Cited

U.S. PATENT DOCUMENTS

| | | | | |
|---|---|---|---|---|
| 4,383,805 | | 5/1983 | Teegarden et al. . | |
| 4,441,863 | | 4/1984 | Hotta et al. . | |
| 4,456,435 | | 6/1984 | Hiraga et al. . | |
| 4,468,178 | | 8/1984 | Hiraga et al. . | |
| 4,497,615 | | 2/1985 | Griffith . | |
| 4,514,150 | | 4/1985 | Hiraga et al. . | |
| 4,566,863 | | 1/1986 | Goto et al. . | |
| 4,673,340 | | 6/1987 | Mabe et al. . | |
| 4,747,756 | | 5/1988 | Sato et al. . | |
| 4,767,293 | | 8/1988 | Caillat et al. . | |
| 4,846,633 | | 7/1989 | Suzuki et al. . | |
| 4,877,382 | | 10/1989 | Caillat et al. . | |
| 4,992,033 | | 2/1991 | Caillat et al. . | |
| 5,074,760 | | 12/1991 | Hirooka et al. . | |
| 5,074,761 | | 12/1991 | Hirooka et al. . | |
| 5,102,316 | | 4/1992 | Caillat et al. . | |
| 5,192,195 | | 3/1993 | Iio et al. . | |
| 5,336,058 | | 8/1994 | Yokoyama . | |
| 5,407,335 | | 4/1995 | Caillat et al. . | |
| 5,551,846 | * | 9/1996 | Taylor et al. | 417/308 |
| 5,562,426 | | 10/1996 | Watanabe et al. . | |
| 5,591,014 | | 1/1997 | Wallis et al. . | |
| 5,607,288 | | 3/1997 | Wallis et al. . | |
| 5,613,841 | | 3/1997 | Bass et al. . | |
| 5,678,985 | * | 10/1997 | Brooke et al. | 417/229 |
| 5,803,716 | | 9/1998 | Wallis et al. . | |
| 5,890,876 | | 4/1999 | Suito et al. . | |
| 6,086,342 | * | 7/2000 | Utter | 418/55.5 |
| 6,120,255 | * | 9/2000 | Schumann et al. | 417/213 |
| 6,168,404 | * | 1/2001 | Gatecliff | 418/55.5 |

FOREIGN PATENT DOCUMENTS

| | | |
|---|---|---|
| A-59-211781 | 11/1984 | (JP) . |
| A-3-202691 | 9/1991 | (JP) . |
| Heisei 3-202691 | 9/1991 | (JP) . |

* cited by examiner

*Primary Examiner*—Charles G. Freay
*Assistant Examiner*—Ed Hayes
(74) *Attorney, Agent, or Firm*—Harness, Dickey & Pierce, P.L.C.

(57) ABSTRACT

A scroll compressor has a pair of scroll members which compress a fluid as the fluid moves through pockets created by the scroll members. The fluid moves from a suction pressure zone to a discharge pressure zone. A chamber is defined by one of the scroll members. The chamber is in communication with a pocket located between the suction and discharge pressure zone such that an intermediate pressurized fluid is supplied to the chamber through a fluid passageway. The fluid passageway is designed to allow a large flow from the pocket to the chamber and a small flow from the chamber to the pocket. This dual flow capability reduces the pressure pulsation in the chamber. In one embodiment, a capacity control mechanism is associated with the compressor to vary the capacity of the compressor.

21 Claims, 5 Drawing Sheets

SCROLL MACHINE WITH ASYMMETRICAL BLEED HOLE

FIELD OF INVENTION

The present invention relates to scroll machines. More particularly, the present invention relates to asymmetrically located bleed holes located in one of the scroll members which provide pressurized fluid for scroll biasing and can also be utilized for a capacity modulation system of the delayed suction type for scroll compressors.

BACKGROUND AND SUMMARY OF THE INVENTION

Scroll type machines are becoming more and more popular for use as compressors in both refrigeration as well as air conditioning applications due primarily to their capability for extremely efficient operation. Generally, these machines incorporate a pair of intermeshed spiral wraps, one of which is caused to orbit relative to the other so as to define one or more moving chambers which progressively decrease in size as they travel from an outer suction port toward a center discharge port. An electric motor is provided which operates to drive the orbiting scroll member via a suitable drive shaft affixed to the motor rotor. In a hermetic compressor, the bottom of the hermetic shell normally contains an oil sump for lubricating and cooling purposes.

In order to expand the use of scroll type machines and to increase the efficiency of these machines, capacity modulation systems have been developed to vary the capacity of these machines. A wide variety of systems have been developed in order to accomplish capacity modulation most of which delay the initial sealing point of the moving fluid pockets defined by the scroll members. In one form, such systems commonly employ a pair of vent passages communicating between suction pressure and the outermost pair of moving fluid pockets. Typically these passages open into the moving fluid pockets at a position normally within 360° of the sealing point of the outer ends of the wraps. Some systems employ a separate valve member for each such vent passage. These valves are intended to be operated simultaneously so as to ensure a pressure balance between the two fluid pockets. Other systems employ additional passages to place the two vent passages in fluid communication thereby enabling use of a single valve to control capacity modulation.

More recently a capacity modulation system for scroll compressors of the delayed suction type has been developed in which a valving ring is movably supported on the non-orbiting scroll member. An actuating piston is provided which operates to rotate the valving ring relative to the non-orbiting scroll member to thereby selectively open and close one or more vent passages which communicate with selective ones of the moving fluid pockets to thereby vent the pockets to suction. A scroll-type compressor incorporating this type of capacity modulation system is disclosed in U.S. Pat. No. 5,678,985 the disclosure of which is hereby incorporated by reference. In this capacity modulation system, the actuating piston is operated by fluid pressure controlled by a solenoid valve.

This capacity modulation system utilizes a pair of axially extending passages in the non-orbiting scroll that place a pair of the moving pockets in fluid communication with the suction pressure zone of the compressor in order to delay the sealing of the moving pockets and thus reduce the capacity of the scroll machine. The delay in the sealing for the pockets reduces the capacity of the scroll machine and therefore reduces the fluid pressure within the pockets when compared with the pressure within the fluid pockets when the compressor is operating in the full load mode. In a scroll compressor which utilizes compressed fluid from the moving pockets to bias the two scroll members together, the reduced pressure within the pockets reduces the fluid pressure biasing the scroll members together which then potentially creates the problem of the scroll members unloading.

In compressors which utilize a floating seal which is biased to close a leakage path between discharge and suction, a similar problem could be created. A lower fluid pressure lowers the biasing load for the seal which potentially creates the problem of the seal falling to open the leakage path between discharge and suction thus unloading the compressor.

In order to prevent unloading of the scroll compressor when the capacity modulation system is actuated, the bleed hole which supplies the biasing fluid for the biasing chamber needs to be moved closer to the discharge port of the compressor. This movement of the bleed hole closer to the discharge port will increase the biasing fluid pressure in both the modulation mode as well as in the full capacity mode. While moving the bleed hole closer to discharge may help resolve the problems associated with compressor unloading during modulated operation, the increase biasing pressurized fluid during full load operation can create other problems with the operation of the compressor. These problems include but are not limited to an increase in the pressure pulsation in the intermediate chamber and an increase in the compression power required.

The present invention provides the art with a bleed hole which allows a relatively large flow of pressurized fluid from the fluid pockets to the intermediate chamber while limiting the flow of pressurized fluid from the intermediate chamber back to the fluid pockets. In one embodiment, this bleed hole is used in conjunction with a capacity modulation system which then allows for the normal placement for the bleed hole. In another embodiment of the present invention, this bleed hole is used in a non-modulated compressor in order to decrease the pressure pulsation in the intermediate chamber.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
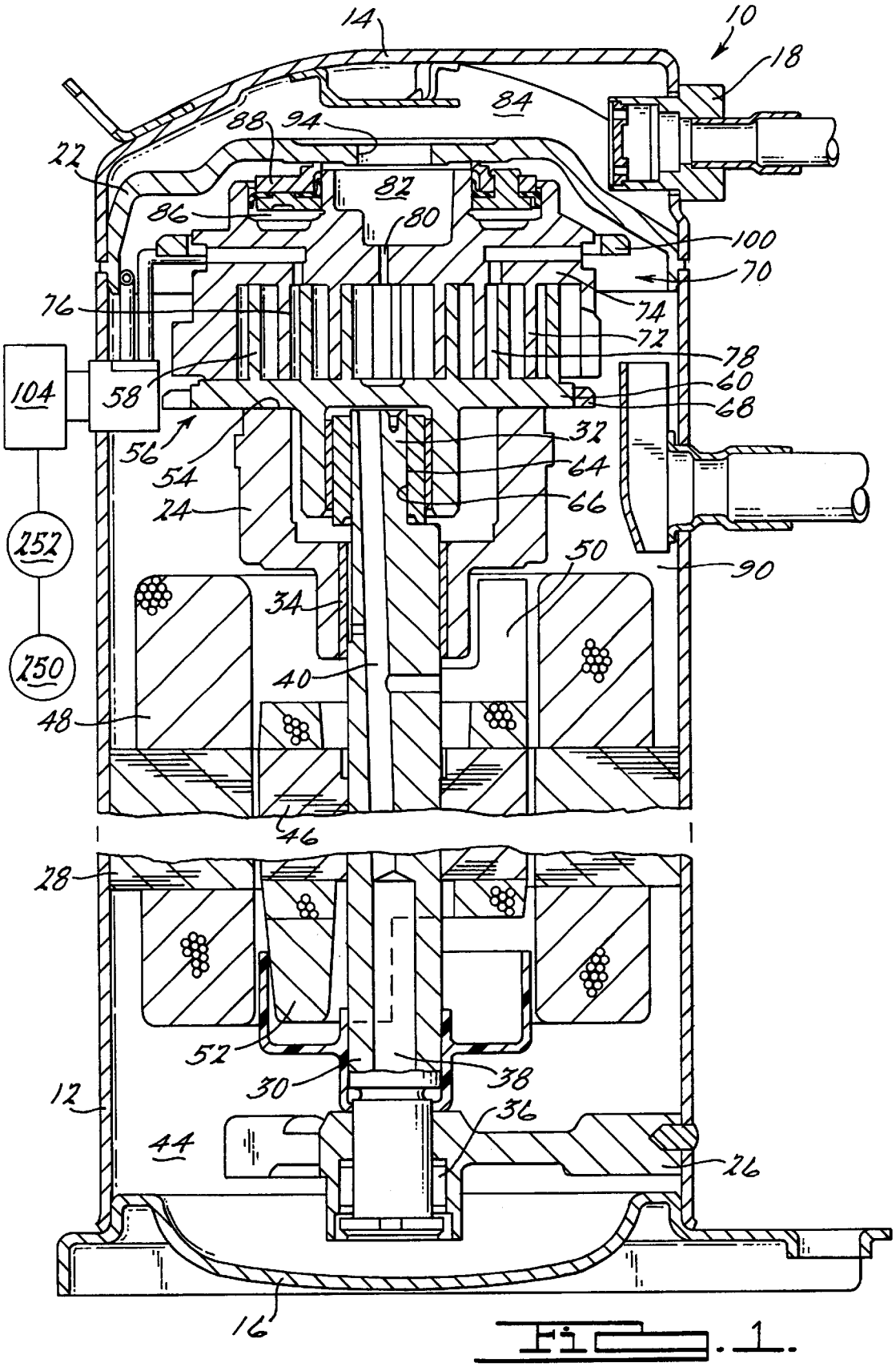
FIG. 1 is a vertical cross-sectional view through the center of a scroll type refrigerant compressor incorporating a capacity modulation system which include the unique bleed hole in accordance with the present invention.

Referring now to the drawings in which like reference numerals designate like or corresponding parts throughout the several views, there is shown in FIG. 1 a scroll compressor which incorporates a bleed hole designed in accordance with the present invention which is designated generally by reference numeral 10. Compressor 10 is generally of the type disclosed in U.S. Pat. No. 4,767,293 issued Aug. 30, 1988 and assigned to the same assignee as the present application, the disclosure of which is hereby incorporated herein by reference. Compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein. Other major elements affixed to the shell include a transversely extending partition 22 which is welded about its periphery at the same point that cap 14 is welded to shell 12, a main bearing housing 24 which is suitably secured to shell 12 and a lower bearing housing 26 having a plurality of radially outwardly extending legs each of which is also suitably secured to shell 12. A motor stator 28 which is generally square in cross-section but with the corners rounded off is press fitted into shell 12. The flats between the rounded corners on the stator provide passageways between the stator and shell, which facilitate the return flow of lubricant from the top of the shell to the bottom.

A drive shaft or crankshaft 30 having an eccentric crank pin 32 at the upper end thereof is rotatably journaled in a bearing 34 in main bearing housing 24 and a second bearing 36 in lower bearing housing 26. Crankshaft 30 has at the lower end a relatively large diameter concentric bore 38 which communicates with a radially outwardly inclined smaller diameter bore 40 extending upwardly therefrom to the top of crankshaft 30. The lower portion of the interior shell 12 defines an oil sump 44 which is filled with lubricating oil to a level slightly above the lower end of a rotor 46, and bore 38 acts as a pump to pump lubricating fluid up the crankshaft 30 and into bore 40 and ultimately to all of the various portions of the compressor which require lubrication.

Crankshaft 30 is rotatively driven by an electric motor including stator 28, windings 48 passing therethrough and rotor 46 press fitted on the crankshaft 30 and having upper and lower counterweights 50 and 52, respectively.

The upper surface of main bearing housing 24 is provided with a flat thrust bearing surface 54 on which is disposed an orbiting scroll member 56 having the usual spiral vane or wrap 58 extending upward from an end plate 60. Projecting downwardly from the lower surface of end plate 60 of orbiting scroll member 56 is a cylindrical hub having a journal bearing 62 therein and in which is rotatively disposed a drive bushing 64 having an inner bore 66 in which crank pin 32 is drivingly disposed. Crank pin 32 has a flat on one surface which drivingly engages a flat surface (not shown) formed in a portion of bore 66 to provide a radially compliant driving arrangement, such as shown in assignee's U.S. Pat. No. 4,877,382, the disclosure of which is hereby incorporated herein by reference. An Oldham coupling 68 is also provided positioned between orbiting scroll member 56 and bearing housing 24 and keyed to orbiting scroll member 56 and a non-orbiting scroll member 70 to prevent rotational movement of orbiting scroll member 56. Oldham coupling 68 is preferably of the type disclosed in assignee's co-pending U.S. Pat. No. 5,320,506, the disclosure of which is hereby incorporated herein by reference.

Non-orbiting scroll member 70 is also provided having a wrap 72 extending downwardly from an end plate 74 which is positioned in meshing engagement with wrap 58 of orbiting scroll member 56 to define moving pockets 76 and 78 which progressively decrease in size as they move inwardly from the outer periphery of scroll members 56 and 70. Non-orbiting scroll member 70 has a centrally disposed discharge passage 80 which communicates with an upwardly open recess 82 which in turn is in fluid communication with a discharge muffler chamber 84 defined by cap 14 and partition 22. An annular recess 86 is also formed in non-orbiting scroll member 70 within which is disposed a seal assembly 88. Recesses 82 and 86 and seal assembly 88 cooperate to define axial pressure biasing chambers which receive pressurized fluid being compressed by wraps 58 and 72 so as to exert an axial biasing force on non-orbiting scroll member 70 to thereby urge the tips of respective wraps 58, 72 into sealing engagement with the opposed end plate surfaces of end plates 74 and 60, respectively. Seal assembly 88 is preferably of the type described in greater detail in U.S. Pat. No. 5,156,539, the disclosure of which is hereby incorporated herein by reference. Non-orbiting scroll member 70 is designed to be mounted to bearing housing 24 in a suitable manner such as disclosed in the aforementioned U.S. Pat. No. 4,877,382 or U.S. Pat. No. 5,407,335, the disclosure of which is hereby incorporated herein by reference.

As thus far described, scroll compressor 10 is typical of such scroll-type refrigeration compressors. In operation, suction gas directed to a lower suction chamber 90 via a suction inlet 92 is drawn into the moving fluid pockets 76 and 78 as orbiting scroll member 56 orbits with respect to non-orbiting scroll member 70. As the moving fluid pockets 76 and 78 move inwardly, this suction gas is compressed and subsequently discharged into discharge chamber 84 via center discharge passage 80 in non-orbiting scroll member 70 and a discharge opening 94 in partition 22. Compressed refrigerant is then supplied to the refrigeration system via discharge fitting 18.

In selecting a refrigeration compressor for a particular application, one would normally choose a compressor having sufficient capacity to provide adequate refrigerant flow for the most adverse operating conditions to be anticipated for that application and may select a slightly larger capacity to provide an extra margin of safety. However, such "worst case" adverse conditions are rarely encountered during actual operation and thus this excess capacity of the compressor results in operation of the compressor under lightly loaded conditions for a high percentage of its operating time. Such operation results in reducing overall operating efficiency of the system. Accordingly, in order to improve the overall operating efficiency under generally encountered operating conditions while still enabling the refrigeration compressor to accommodate the "worst case" operating conditions, compressor 10 is provided with a capacity modulation system.

The capacity modulation system includes an annular valving ring 100 movably mounted on non-orbiting scroll member 70, an actuating assembly 102 supported within shell 12 and a control system 104 for controlling operation of the actuating assembly.

Figure 2:
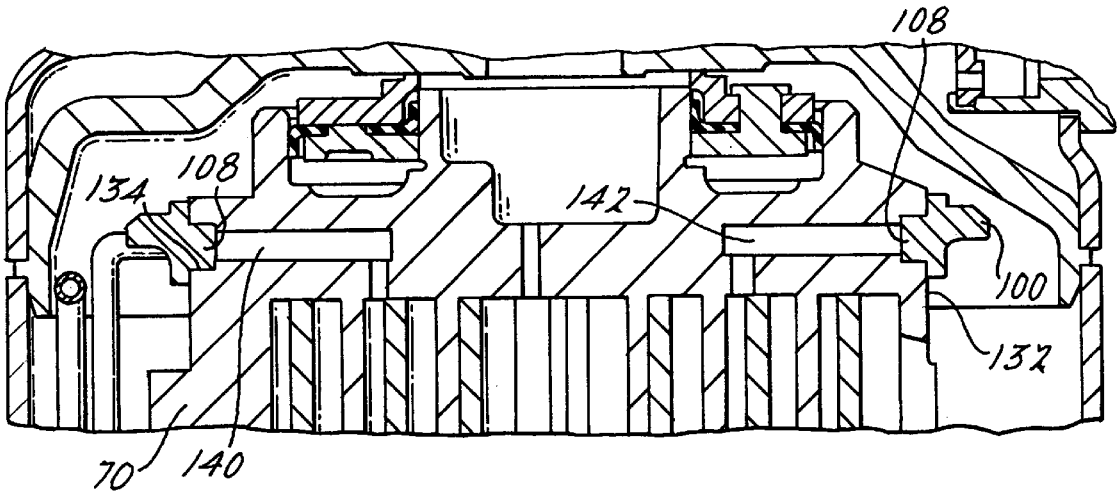
FIG. 2 is a fragmentary view of the compressor shown in FIG. 1 showing the valve ring in a closed or unmodulated position.
Figure 4:
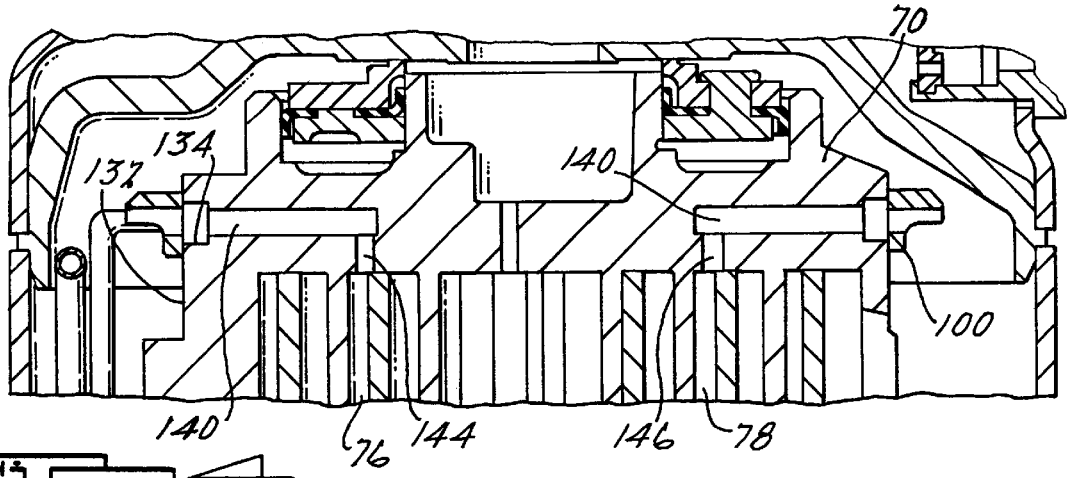
FIG. 4 is a fragmentary view of the compressor shown in FIG. 1 showing the valve ring in an open or modulated position.
Figure 5:
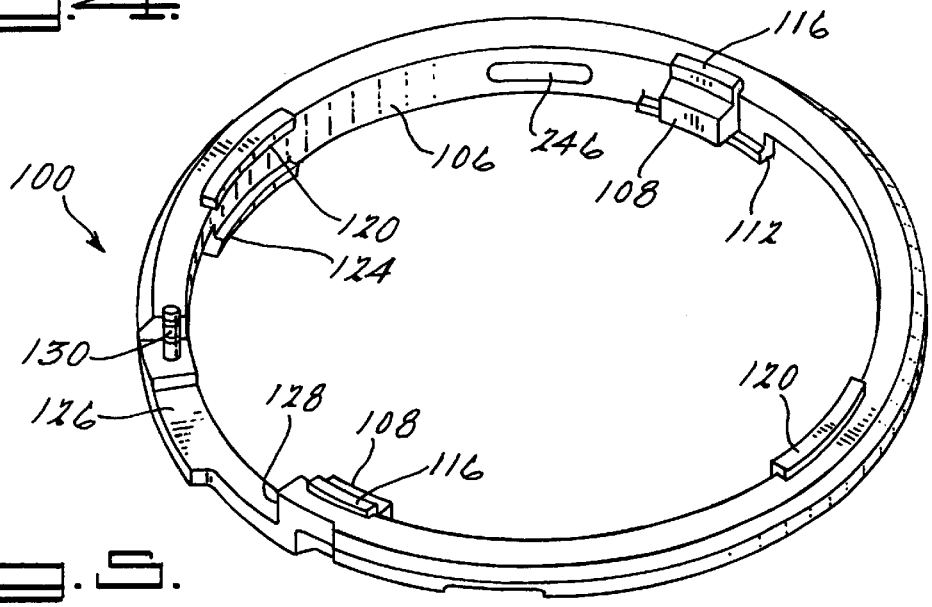
FIG. 5 is a perspective view of the valving ring incorporated in the compressor shown in FIG. 1.

As best seen with reference to FIGS. 2, 4 and 5, valving ring 100 comprises a generally circularly shaped main body 106 having a pair of substantially diametrically opposed radially inwardly extending protrusions 108 provided thereon of substantially identical predetermined axial and circumferential dimensions. Suitable substantially identical circumferentially extending guide surfaces 112 and 116 are provided adjacent axially opposite sides of each of protrusions 108. Additionally, two pairs of substantially identical circumferentially extending axially spaced guide surfaces 120 and 124 are provided on main body 106, each being positioned in substantially diametrically opposed relationship to each other and spaced circumferentially approximately 90° from each protrusions 108. As shown, guide surfaces 124 project radially inwardly slightly from main body 106 as do guide surfaces 112. Preferably, guide surfaces 124 and 112 are all axially aligned and lie along the periphery of a circle of a radius slightly less than the radius of main body 106. Similarly, guide surfaces 120 project radially inwardly slightly from main body 106 as do guide surfaces 116 with which they are preferably axially aligned. Also surfaces 120 and 116 lie along the periphery of a circle of a radius slightly less than the radius of main body 106 and preferably substantially equal to the radius of the circle along which surfaces 124 and 112 lie. Main body 106 also includes a circumferentially extending stepped portion 126 which includes an axially extending circumferentially facing stop surface 128 at one end. Step portion 126 is positioned between protrusion 108 and guide surfaces 120, 124. A pin member 130 is also provided extending axially upwardly adjacent one end of stepped portion 126. Valving ring 100 may be fabricated from a suitable metal such as aluminum or alternatively may be formed from a suitable polymeric composition and pin member 130 may be either pressed into a suitable opening provided therein or integrally formed therewith.

Figure 3:
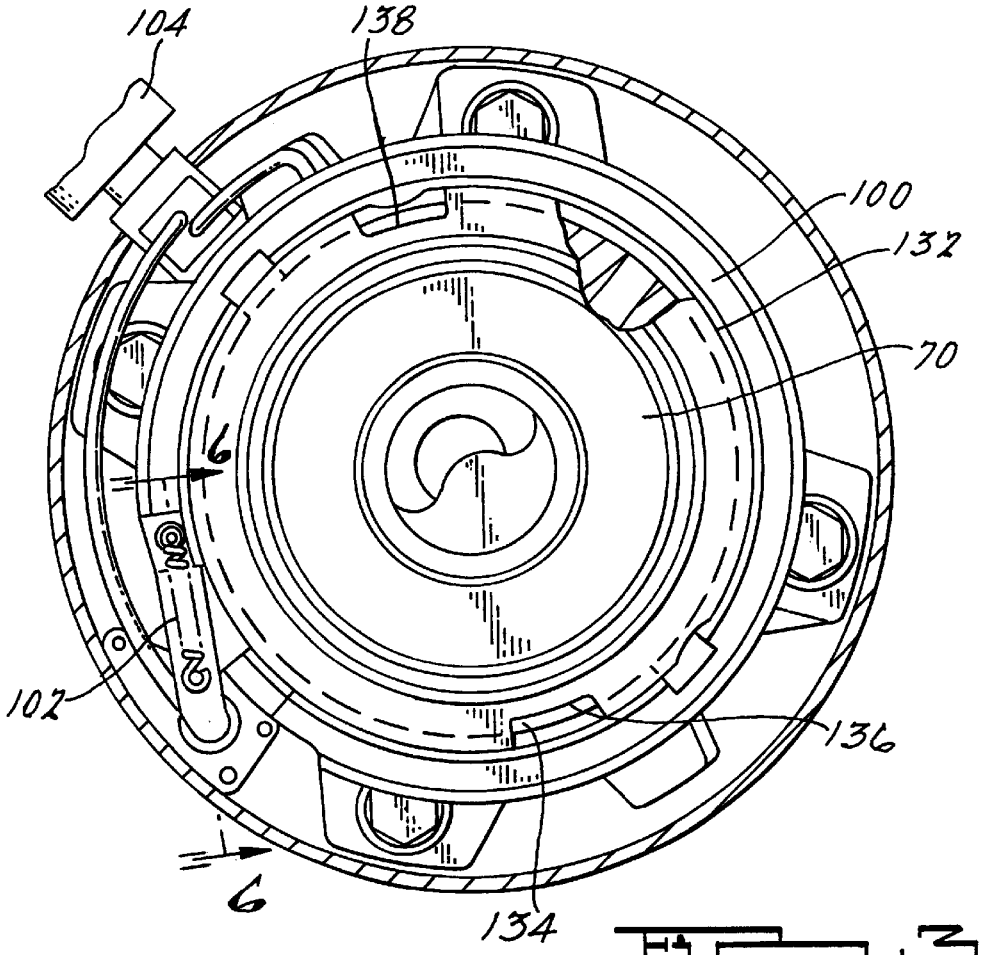
FIG. 3 is a plan view of the compressor shown in FIG. 1 with the top portion of the outer shell removed.

As previously mentioned, valving ring 100 is designed to be movably mounted on non-orbiting scroll member 70. In order to accommodate valving ring 100, non-orbiting scroll member 70 includes a radially outwardly facing cylindrical sidewall portion 132 thereon having an annular groove 134 formed therein adjacent the upper end thereof. In order to enable valving ring 100 to be assembled to non-orbiting scroll member 70, a pair of diametrically opposed substantially identical radially inwardly extending notches 136 and 138 are provided in non-orbiting scroll member 70 each opening into groove 134 as best seen with reference to FIG. 3. Notches 136 and 138 have a circumferentially extending dimension slightly larger than the circumferential extent of protrusions 108 on valving ring 100.

Groove 134 is sized to movably accommodate protrusions 108 when valving ring is assembled thereto and notches 136 and 138 are sized to enable protrusions 108 to be moved into groove 134. Additionally, cylindrical sidewall portion 132 will have a diameter such that guide surfaces 112, 116, 120 and 124 will slidingly support rotary movement of valving ring 100 with respect to non-orbiting scroll member 70.

Non-orbiting scroll member 70 also includes a pair of generally diametrically opposed radially extending passages 140 and 142 opening into the inner surface of groove 134 and extending generally radially inwardly through the end plate of non-orbiting scroll member 70. An axially extending passage 144 places the inner end of passage 140 in fluid communication with moving fluid pocket 76 while a second axially extending passage 146 places the inner end of passage 142 in fluid communication with moving fluid pocket 78. Preferably, passages 144 and 146 will be oval in shape so as to maximize the size of the opening thereof without having a width greater than the width of the wrap of the orbiting scroll member 56. Passage 144 is positioned adjacent an inner sidewall surface of scroll wrap 72 and passage 146 is positioned adjacent an outer sidewall surface of wrap 72. Alternatively passages 144 and 146 may be round if desired however the diameter thereof should be such that the opening does not extend to the radially inner side of the orbiting scroll member 56 as it passes thereover.

Figure 6:
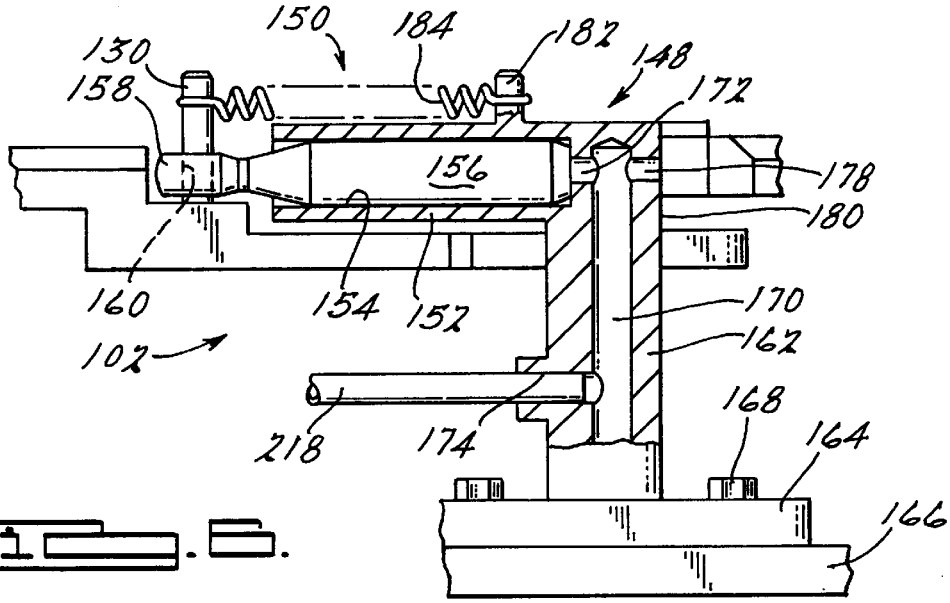
FIG. 6 is an enlarged detail view of the actuating assembly incorporating into the compressor of FIG. 1.

As best seen with reference to FIG. 6, actuating assembly 102 includes a piston and cylinder assembly 148 and a return spring assembly 150. Piston and cylinder assembly 148 includes a housing 152 having a bore defining a cylinder 154 extending inwardly from one end thereof and within which a piston 156 is movably disposed. An outer end 158 of piston 156 projects axially outwardly from one end of housing 152 and includes an elongated or oval-shaped opening 160 therein adapted to receive pin 130 forming a part of valving ring 100. Elongated or oval opening 160 is designed to accommodate the arcuate movement of pin 130 relative to the linear movement of piston end 158 during operation. A depending portion 162 of housing 152 has secured thereto a suitably sized mounting flange 164 which is adapted to enable housing 152 to be secured to a suitable flange member 166 by bolts 168. Flange 166 is in turn suitably supported within outer shell 12 such as by bearing housing 24.

A passage 170 is provided in depending portion 162 extending upwardly from the lower end thereof and opening into a laterally extending passage 172 which in turn opens into the inner end of cylinder 154. A second laterally extending passage 174 provided in depending portion 162 opens outwardly through the sidewall thereof and communicates at its inner end with passage 170. A second relatively small laterally extending passage 178 extends from fluid passage 170 in the opposite direction of fluid passage 172 and opens outwardly through an end wall 180 of housing 152.

A pin member 182 is provided upstanding from housing 152 to which is connected one end of a return spring 184 the other end of which is connected to an extended portion of pin 130. Return spring 184 will be of such a length and strength as to urge ring 100 and piston 156 into the position shown in FIG. 7 when cylinder 154 is fully vented via passage 178.

Figure 7:
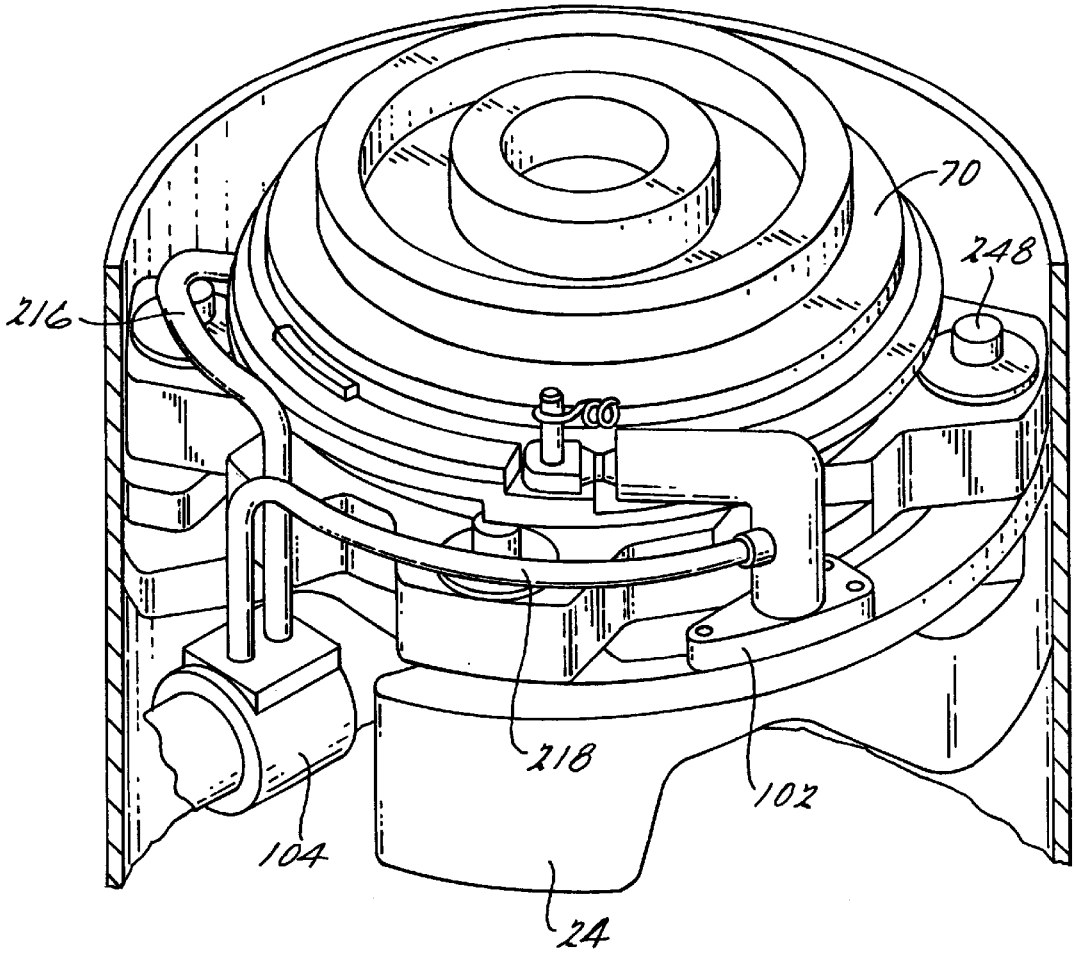
FIG. 7 is a perspective view of the compressor of FIG. 1 with portions of the outer shell broken away.
Figure 9:
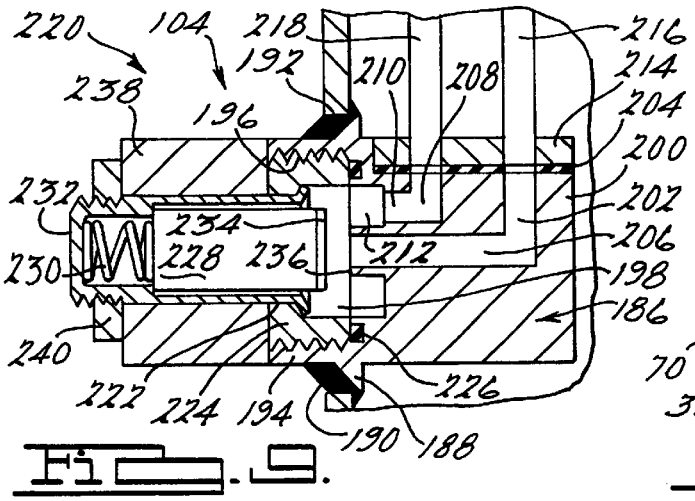
FIG. 9 is an enlarged section view of the solenoid valve assembly incorporated in the compressor of FIG. 1.

As best seen with reference to FIGS. 7 and 9, control system 104 includes a valve body 186 having a radially outwardly extending flange 188 including a conical surface 190 on one side thereof. Valve body 186 is inserted into an opening 192 in outer shell 12 and positioned with conical surface 190 abutting the peripheral edge of opening 192 and then welded to shell 12 with a cylindrical portion 194 projecting outwardly therefrom. Cylindrical portion 194 of valve body 186 includes an enlarged diameter threaded bore 196 extending axially inwardly and opening into a recessed area 198.

Valve body 186 includes a housing 200 having a first passage 202 extending downwardly from a substantially flat upper surface 204 and intersecting a second laterally extending passage 206 which opens outwardly into the area of opening 192 in shell 12. A third passage 208 also extends downwardly from surface 204 and intersects a fourth laterally extending passage 210 which also opens outwardly into a recessed area 212 provided in the end portion of body 186.

A manifold 214 is sealingly secured to surface 204 by means of suitable fasteners and includes fittings for connection of one end of each of fluid lines 216 and 218 so as to place them in sealed fluid communication with respective passages 202 and 208.

A solenoid coil assembly 220 is designed to be sealingly secured to valve body 186 and includes an elongated tubular member 222 having a threaded fitting 224 sealingly secured to the open end thereof. Threaded fitting 224 is adapted to be threadedly received within bore 196 and sealed thereto by means of an O-ring 226. A plunger 228 is movably disposed within tubular member 222 and is biased outwardly therefrom by a spring 230 which bears against a closed end 232 of tubular member 222. A valve member 234 is provided on the outer end of plunger 228 and cooperates with a valve seat 236 to selectively close off passage 206. A solenoid coil 238 is positioned on tubular member 222 and secured thereto by means of a nut 240 threaded on the outer end of tubular member 222.

Figure 8:
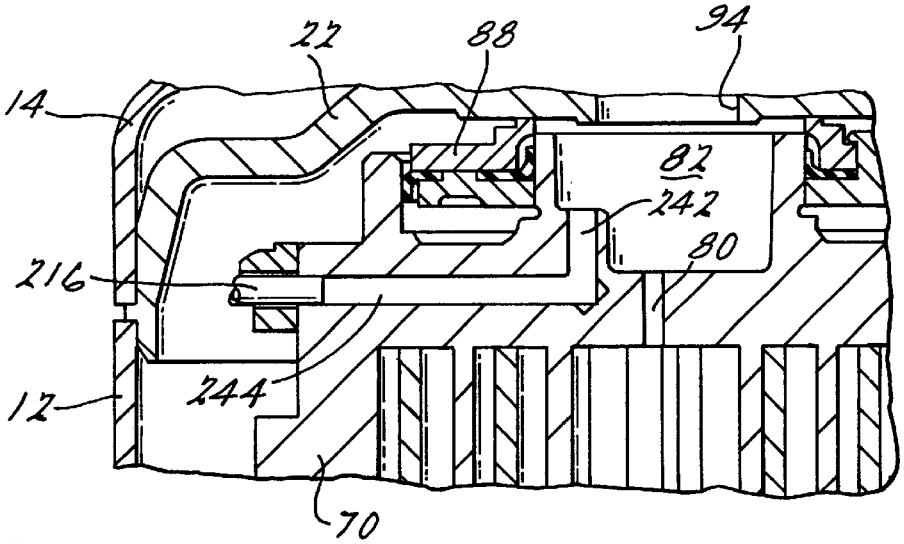
FIG. 8 is a fragmentary section view of the compressor of FIG. 1 showing the pressurized fluid supply passages provided in the non-orbiting scroll.

In order to supply pressurized fluid to actuating assembly 102, an axially extending passage 242 extends downwardly from recess 82 and connects to a generally radially extending passage 244 in non-orbiting scroll member 70. Passage 244 extends radially and opens outwardly through the circumferential sidewall of non-orbiting scroll 70 as best seen with reference to FIG. 8. The other end of fluid line 216 is sealingly connected to passage 244 whereby a supply of compressed fluid may be supplied from annular recess 86 to valve body 186. A circumferentially elongated opening 246 is provided in valving ring 100 suitably positioned so as to enable fluid line 216 to pass therethrough while accommodating the rotational movement of ring 100 with respect to non-orbiting scroll member 70.

In order to supply pressurized fluid from valve body 186 to actuating piston 156 and cylinder assembly 148, fluid line 218 extends from valve body 186 and is connected to passage 174 provided in depending portion 162 of housing 152.

Valving ring 100 may be easily assembled to non-orbiting scroll member 70 by merely aligning protrusions 108 with respective notches 136 and 138 and moving protrusions 108 into annular groove 134. Thereafter valving ring 100 is rotated into the desired position with the axially upper and lower surfaces of protrusions 108 cooperating with guide surfaces 112, 116, 120 and 124 to movably support valving ring 100 on non-orbiting scroll member 70. Thereafter, housing 152 of actuating assembly 102 may be positioned on mounting flange 166 with piston end 158 receiving pin 130. One end of spring 184 may then be connected to pin member 182. Thereafter, the other end of spring 184 may be connected to pin 130 thus completing the assembly process.

While non-orbiting scroll member 70 is typically secured to main bearing housing 24 by suitable bolts 248 prior to assembly of valving ring 100, it may in some cases be preferable to assemble this capacity modulation component to non-orbiting scroll member 70 prior to assembly of non-orbiting scroll member 70 to main bearing housing 24. This may be easily accomplished by merely providing a plurality of suitably positioned arcuate cutouts along the periphery of valving ring 100. These cutouts will afford access to securing bolts 248 with valving ring assembled to non-orbiting scroll member 70.

In operation, when system operating conditions as sensed by one or more sensors 250 indicate that full capacity of compressor is required, controller 252 will operate in response to a signal from sensor 250 to energize solenoid coil 238 of solenoid assembly 220 thereby causing plunger 228 to be moved out of engagement with valve seat 236 thereby placing passages 206 and 210 in fluid communication. Pressurized fluid at substantially discharge pressure will then be allowed to flow from recess 82 to cylinder 154 via passages 242, 244, fluid line 216, passages 208, 210, 206, 202, fluid line 218 and passages 174, 170 and 172. This fluid pressure will then cause piston 156 to move outwardly with respect to cylinder 154 thereby rotating valving ring so as to move protrusions 108 into sealing overlying relationship to passages 140 and 142. This will then prevent suction gas drawn into the moving fluid pockets defined by interengaging scroll members 56 and 70 from being exhausted or vented through passages 140 and 142.

When the load conditions change to the point that the full capacity of compressor 10 is not required, sensor 250 will provide a signal indicative thereof to controller 252 which in turn will deenergize coil 238 of solenoid assembly 220. Plunger 228 will then move outwardly from tubular member 222 under the biasing action of spring 230 thereby moving valve member 234 into sealing engagement with seat 236 thus closing off passage 206 and the flow of pressurized fluid therethrough. It is noted that recessed area 212 will be in continuous fluid communication with recess 82 and hence continuously subject to discharge pressure. This discharge pressure will aid in biasing valve member 234 into fluid tight sealing engagement with valve seat 236 as well as retaining same in such relationship.

The pressurized gas contained in cylinder 154 will bleed back into chamber 90 via vent passage 178 thereby enabling spring 184 to rotate valving ring 100 back to a position in which passages 140 and 142 are no longer closed off by protrusions 108. Spring 184 will also move piston 156 inwardly with respect to cylinder 154. In this position a portion of the suction gas being drawn into the moving fluid pockets defined by the interengaging scroll members 56 and 70 will be exhausted or vented through passages 140 and 142 until such time as the moving fluid pockets have moved out of communication with passages 144 and 146 thus reducing the volume of the suction gas being compressed and hence the capacity of the compressor. It should be noted that by arranging the modulation system such that compressor 10 is normally in a reduced capacity mode of operation (i.e., solenoid coil is deenergized and hence no fluid pressure is being supplied to the actuating piston cylinder assembly), this system offers the advantage that the compressor will be started in a reduced capacity mode thus requiring a lower starting torque. This enables use of a less costly lower starting torque motor if desired.

It should be noted that the speed with which the valving ring may be moved between the modulated position of FIG. 4 and the unmodulated position of FIG. 2 will be directly related to the relative size of vent passage 178 and the size of the supply lines. In other words, because passage 178 is continuously open to chamber 90 which is at suction pressure, a portion of the pressurized fluid flowing from annular recess 86 will be continuously vented to suction pressure. The volume of this fluid will be controlled by the relative sizing of passage 178. However, as passage 178 is reduced in size, the time required to vent cylinder 154 will increase thus increasing the time required to switch from reduced capacity to full capacity.

While the above embodiment has been described utilizing a passage 178 provided in housing 152 to vent actuating pressure from cylinder 154 to thereby enable compressor 10 to return to reduced capacity, it is also possible to delete passage 178 and incorporate a vent passage in valve body 186 in place thereof.

Figure 10:
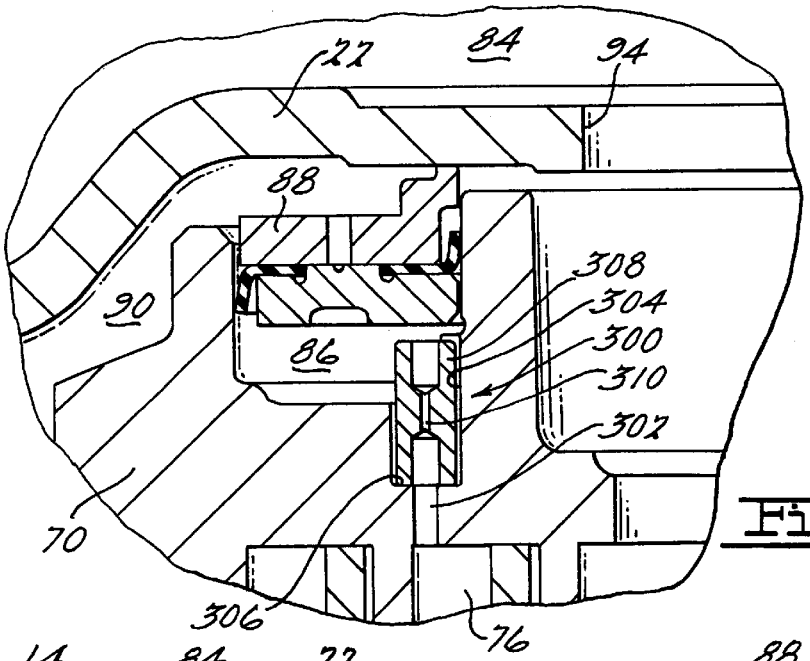
FIG. 10 is an enlarged view of the bleed hole in the non-orbiting scroll shown in FIG. 1.

Referring now to FIG. 10, the unique bleed hole in accordance with the present invention is illustrated. Annular recess 86 is designed to receive pressurized fluid from at least one of pockets 76 and 78 in order to bias seal assembly 88 against partition 22 to separate discharge chamber 84 from suction chamber 90. A bleed hole 300 extends through non-orbiting scroll member 70 for this purpose. Bleed hole 300 comprises a first smaller bleed hole 302 opening into one of pockets 76 or 78 and a second larger bleed hole 304 in communication with bleed hole 302 and opening into annular recess 86. A shoulder or seal surface 306 is defined by bleed holes 302 and 304. Disposed for axial movement within bleed hole 304 is a valve member 308. Valve member 308 defines a flow orifice 310 which extends through valve member 308. Valve member 308 controls the flow of pressurized lubricant through bleed hole 300. When the fluid pressure within pocket 76 or 78 is greater than the fluid pressure within annular recess 86, valve member 308 is lifted off of seal surface 306 due to fluid pressure to allow a relatively large flow of refrigerant around valve member 308. The large flow of refrigerant around valve member 308 is permitted because the diameter of bleed hole 304 is greater than the diameter of valve member 308. When the fluid pressure within annular recess 86 is greater than the fluid pressure within pocket 76 or 78, valve member 308 is urged against seal surface 306 due to fluid pressure. When valve member 308 is urged against seal surface 306 the flow of refrigerant is reduced to a relatively small amount due to flow orifice 310.

Thus, by allowing a large flow of pressurized lubricant into annular recess 86 from pockets 76 or 78 and limiting the amount of flow of pressurized fluid from annular recess 86 to pockets 76 or 78, bleed hole 300 is able to prevent the unloading of the scroll compress, decrease the pressure pulsations in annular recess 86 and decrease the compression power required.

Figure 11:
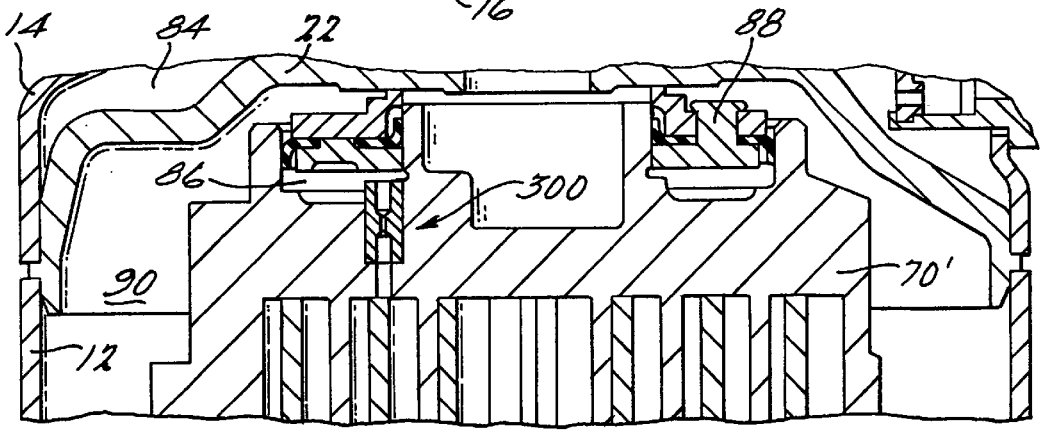
FIG. 11 is a fragmentary view of a compressor incorporating the bleed hole in accordance with the present invention but without a capacity modulation system.

Referring now to FIG. 11, bleed hole 300 is shown disposed within a non-orbiting scroll 70' which does not include the capacity control modulation system shown in FIGS. 1–9. In a non-capacity modulated or a fixed capacity scroll machine, the incorporation of bleed hole 300 will help to reduce the pressure pulsations within annular recess 86 due to the continued movement of pocket 76 or 78 from suction chamber 90 to discharge chamber 84. The decrease in the pressure pulsations will again help to decrease the compression power required.

Figure 12:
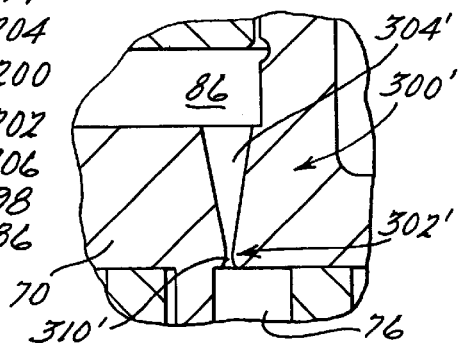
FIG. 12 is an enlarged view of a bleed hole in a non-orbiting scroll in accordance with another embodiment of the present invention.

Referring now to FIG. 12, a bleed hole 300' is disclosed. Bleed hole 300' can replace bleed hole 300 in either a capacity modulated scroll machine or a fixed capacity (non-capacity modulated) machine if desired. Bleed hole 300' defines a first smaller bleed hole 302' opening into pocket 76 or 78 and a second frusto-conical shaped diffuser passage 304' in communication with bleed hole 302' opening into annular recess 86. Smaller bleed hole 302' forms a flow orifice 310'. Frusto-conical shaped diffuser passage 304' will provide less of a flow restriction and thus an increase in flow when the flow is from pocket 76 or 78 to annular recess 86 and more of a flow restriction and thus a decrease in flow when the flow is from annular recess 86 to pocket 76 or 78. Thus, bleed hole 300' provides the same effect and advantages as those described above for bleed hole 300.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

a first scroll member having a first spiral wrap projecting outwardly from a first end plate;

a second scroll member having a second spiral wrap projecting outwardly from a second end plate;

a drive member causing said scroll members to orbit relative to one another whereby said spiral wraps will create pockets of progressively changing volume between a suction pressure zone at a suction pressure and a discharge pressure zone at a discharge pressure;

means defining a leakage path disposed between two elements of said scroll machine, said leakage path extending from said discharge pressure zone to said suction pressure zone;

means defining a chamber containing an intermediate pressurized fluid said intermediate pressurized fluid being at a pressure between said suction pressure and said discharge pressure, said chamber being in communication with one of said two elements of said scroll machine to bias said one element into engagement with the other of said two elements to close said leakage path;

a fluid passageway extending between one of said pockets of progressively changing volume and said chamber; and means disposed within said fluid passageway for providing a first fluid flow level from said chamber to said one pocket for said intermediate pressurized fluid and a second fluid flow level from said one pocket to said chamber for said intermediate pressurized fluid, said second fluid flow level being greater than said first fluid flow level.

2. The scroll machine according to claim 1, wherein said providing means comprises a valve member disposed within said fluid passageway.

3. The scroll machine according to claim 2, wherein said fluid passageway includes a first portion and a second portion, said second portion being larger than said first portion, said valve member being disposed within said second portion.

4. The scroll machine according to claim 2, wherein said valve member defines a fluid flow orifice extending through said valve member.

5. The scroll machine according to claim 2, wherein said fluid passageway defines a shoulder, said valve member sealingly engaging said shoulder.

6. The scroll machine according to claim 5, wherein said valve member defines a fluid flow orifice extending through said valve member.

7. The scroll machine according to claim 1, wherein said fluid passageway includes a first portion and a second portion, said second portion being larger than said first portion.

8. The scroll machine according to claim 7, wherein said second portion of said fluid passageway is frusto-conically shaped.

9. The scroll machine according to claim 1, further comprising a capacity modulation system for changing the capacity of said scroll machine.

10. The scroll machine according to claim 9, wherein said providing means comprises a valve member disposed within said fluid passageway.

11. The scroll machine according to claim 9, wherein said fluid passageway includes a first portion and a second portion, said second portion being larger than said first portion.

12. The scroll machine according to claim 11, wherein said second portion of said fluid passageway is frustoconically shaped.

13. The scroll machine according to claim 9, wherein said capacity modulation system comprises:

a vent for placing at least one of said pockets in communication with said suction pressure zone; and a fluid pressure actuated valve for selectively opening and closing said vent to thereby change the capacity of said scroll machine.

14. The scroll machine according to claim 13, wherein said vent and said at least one of said pockets is in communication with said chamber.

15. The scroll machine according to claim 1, wherein said fluid passageway includes a first portion having a first diameter and a second portion having a second diameter, said second diameter being larger than said first diameter to define a shoulder.

16. The scroll machine according to claim 15, wherein said scroll machine further comprises a valve member disposed within said second portion of said fluid passageway, said valve member defining a fluid flow orifice having a third diameter, said third diameter being smaller than said first diameter.

17. The scroll machine according to claim 15, wherein said valve member is moved by fluid pressure between a first position sealingly engaging said shoulder and a second position spaced from said shoulder.

18. The scroll machine according to claim 15, further comprising a capacity modulation system for changing the capacity of said scroll machine.

19. The scroll machine according to claim 18, wherein said capacity modulation system comprises:

a vent for placing at least one of said pockets in communication with said suction pressure zone; and a fluid pressure actuated valve for selectively opening and closing said vent to thereby change the capacity of said scroll machine.

20. The scroll machine according to claim 19, wherein said vent and said at least one of said pockets is in communication with said chamber.

21. The scroll machine according to claim 1, wherein said fluid passage is continuously open.

* * * * *